US009835145B1

(12) United States Patent
Freeman

(10) Patent No.: US 9,835,145 B1
(45) Date of Patent: Dec. 5, 2017

(54) THERMAL ENERGY RECOVERY SYSTEMS

(71) Applicant: Walter B. Freeman, Cave Junction, OR (US)

(72) Inventor: Walter B. Freeman, Cave Junction, OR (US)

( * ) Notice: Subject to any disclaimer, the term of this patent is extended or adjusted under 35 U.S.C. 154(b) by 0 days.

(21) Appl. No.: 13/653,360

(22) Filed: Oct. 16, 2012

Related U.S. Application Data

(60) Provisional application No. 61/551,359, filed on Oct. 25, 2011.

(51) Int. Cl.
*F04B 9/113* (2006.01)
*F04B 43/113* (2006.01)

(52) U.S. Cl.
CPC ..... *F04B 9/113* (2013.01); *F04B 43/113* (2013.01)

(58) Field of Classification Search
CPC ..... F04B 9/113; F04B 9/125–9/1256; F04B 9/133; F04B 43/113; F04B 43/1136; F04B 43/1133
USPC ..... 60/645, 655, 659; 417/379, 397, 403
See application file for complete search history.

(56) References Cited

U.S. PATENT DOCUMENTS

| | | | | | |
|---|---|---|---|---|---|
| 153,296 | A * | 7/1874 | Atkinson | F04B 9/113 | 417/397 |
| 213,615 | A | 3/1879 | Blake | | |
| 330,388 | A | 11/1885 | Dow | | |
| 391,941 | A | 10/1888 | Brown | | |
| 969,027 | A | 8/1910 | Benson | | |
| 1,437,704 | A | 12/1922 | Barrance | | |
| 1,748,445 | A | 11/1927 | Fahdt | | |
| 1,690,126 | A | 11/1929 | Nieleback | | |
| 1,746,104 | A | 2/1930 | Chritiansen | | |
| 1,962,986 | A | 6/1934 | Dole | | |
| 1,979,161 | A | 10/1934 | Klein et al. | | |
| 2,134,466 | A | 10/1938 | Lentz et al. | | |
| 2,264,518 | A | 1/1941 | Foster | | |
| 2,652,034 | A | 5/1950 | Baillot et al. | | |
| 3,609,061 | A * | 9/1971 | Peoples | 417/36 | |
| 4,204,406 | A * | 5/1980 | Hopfe | B01D 61/10 | 290/53 |
| 4,272,226 | A * | 6/1981 | Osborne | H02K 41/02 | 310/14 |
| 5,832,728 | A * | 11/1998 | Buck | 60/407 | |
| 5,984,642 | A * | 11/1999 | Danielsson | F15B 3/00 | 417/264 |
| 6,481,393 | B1 | 11/2002 | Drew | | |
| 7,413,418 | B2 | 8/2008 | Lane et al. | | |
| 7,472,544 | B1 * | 1/2009 | Knight | F02K 9/56 | 417/397 |

(Continued)

FOREIGN PATENT DOCUMENTS

| | | | | |
|---|---|---|---|---|
| GB | 2334076 A * | 8/1999 | F04B 9/133 | |
| WO | WO 2010149972 A2 * | 12/2010 | F03B 17/02 | |

*Primary Examiner* — Mark Laurenzi
*Assistant Examiner* — Mickey France
(74) *Attorney, Agent, or Firm* — Jerry Haynes Law

(57) ABSTRACT

Thermal energy recovery systems include a piston assembly including a primary cylinder adapted to receive vapor; first and second secondary cylinders extending from opposite ends of the primary cylinder; a primary piston disposed for displacement in the primary cylinder; first and second secondary pistons disposed for displacement in the first and second secondary cylinders, respectively; and a piston connecting member connecting the first and second secondary pistons to the primary piston.

4 Claims, 4 Drawing Sheets

(56) References Cited

U.S. PATENT DOCUMENTS

| | | | | |
|---|---|---|---|---|
| 7,900,444 | B1 | 3/2011 | McBride et al. | |
| 2006/0174613 | A1 | 8/2006 | Pritchard | |
| 2008/0110171 | A1* | 5/2008 | Schmeltz | F02G 5/02 60/616 |
| 2011/0100213 | A1* | 5/2011 | Finkenrath et al. | 95/92 |
| 2011/0308248 | A1* | 12/2011 | Stroganov | F01K 27/005 60/641.8 |

* cited by examiner

THERMAL ENERGY RECOVERY SYSTEMS

CROSS-REFERENCE TO RELATED APPLICATIONS

This application claims the benefit of U.S. provisional application No. 61/551,359, filed Oct. 25, 2012 and entitled THERMAL ENERGY RECOVERY SYSTEMS, which provisional application is incorporated by reference herein in its entirety.

FIELD OF THE INVENTION

Illustrative embodiments of the disclosure generally relate to systems which exploit thermal energy for various purposes. More particularly, illustrative embodiments of the disclosure relate to thermal energy recovery systems which render thermal energy available for a variety of purposes.

BACKGROUND OF THE INVENTION

Thermal energy is useful in a variety of applications such as heating and cooking. In some applications, it may be desirable to exploit thermal energy which is obtained from a readily-available thermal energy source for various purposes.

Accordingly, thermal energy recovery systems which render thermal energy available for a variety of purposes may be desirable for some applications.

SUMMARY OF THE INVENTION

Illustrative embodiments of the disclosure are generally directed to thermal energy recovery systems. An illustrative embodiment of the thermal energy recovery system includes a piston assembly including a primary cylinder adapted to receive vapor and/or hot liquid in such a state or condition as to become vapor; first and second secondary cylinders extending from opposite ends of the primary cylinder; a primary piston disposed for displacement in the primary cylinder; first and second secondary pistons disposed for displacement in the first and second secondary cylinders, respectively; and a piston connecting member connecting the first and second secondary pistons to the primary piston.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
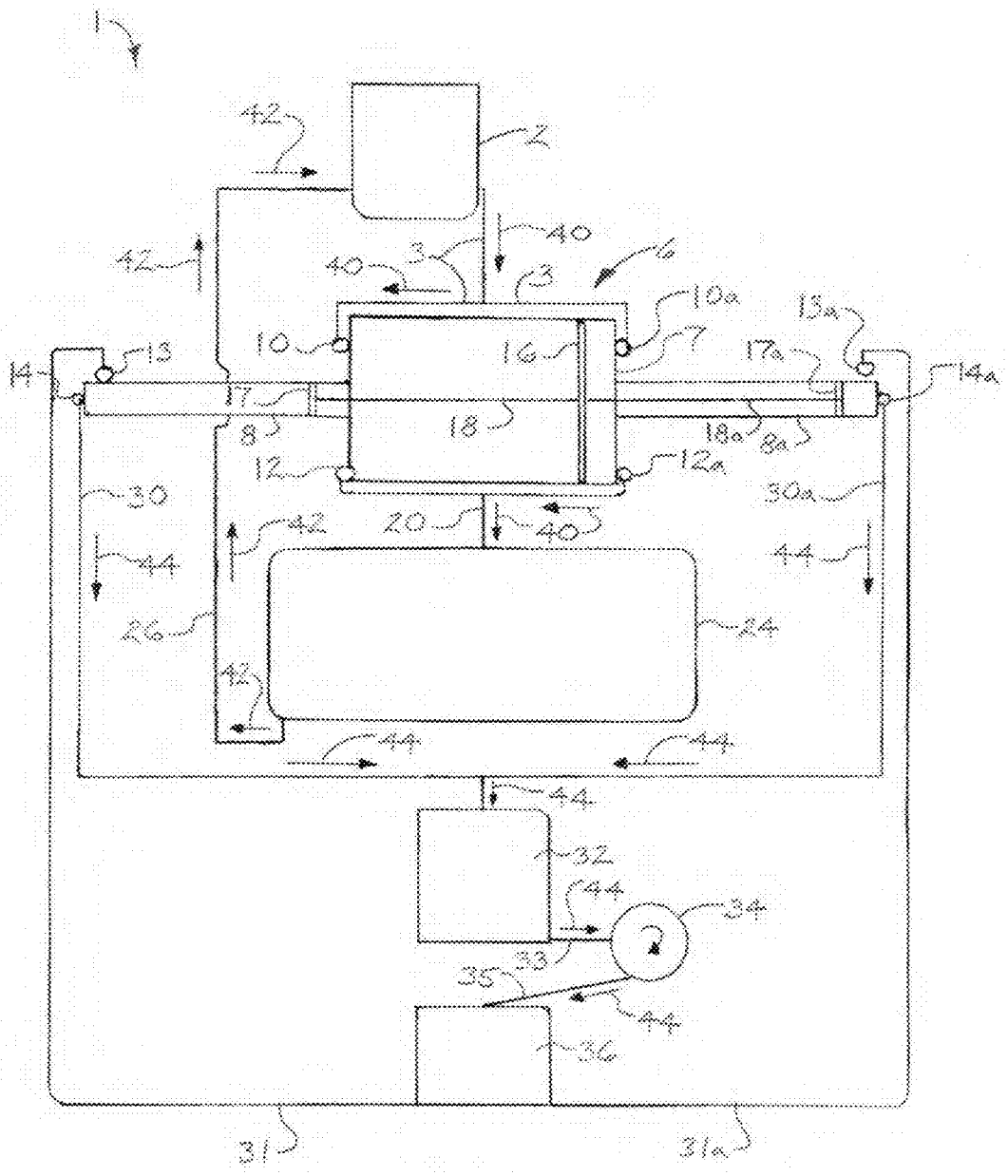
FIG. 1 is a block diagram of an illustrative embodiment of a thermal energy recovery system.

Referring initially to FIG. 1 of the drawings, an illustrative embodiment of a thermal energy recovery system is generally indicated by reference numeral 1. The thermal energy recovery system 1 may include a boiler 2 which in some embodiments may be adapted to form vapor 40 from a liquid 42. In other embodiments, the boiler 2 may be adapted to receive vapor 40 from a vapor source (not illustrated). A piston assembly 6 may include a primary cylinder 7 which may have a generally elongated, cylindrical configuration and secondary cylinders 8, 8*a* which may extend from opposite ends of the primary cylinder 7. Cylinder inlet valves 10, 10*a* may be provided at opposite ends of the primary cylinder 7. Alternatively, a liquid injection system can be used in conjunction with or in place of inlet valves. The cylinder inlet valves 10, 10*a* may be disposed in fluid communication with the boiler 2 through boiler outlet conduits 3. Cylinder outlet valves 12, 12*a* may be provided at opposite ends of the primary cylinder 7. The cylinder outlet valves 12, 12*a* may be disposed generally in opposite or diametrically-opposed relationship to the cylinder inlet valves 10, 10*a*, respectively.

A primary piston 16 may sealingly engage the interior surface of the primary cylinder 7. The primary piston 16 may be adapted for slidable displacement between the opposite ends of the primary cylinder 7. A secondary piston 17 may sealingly and slidably engage the interior surface of the secondary cylinder 8. A secondary piston 17*a* may sealingly and slidably engage the interior surface of the secondary cylinder 8*a*. Piston connecting members 18, 18*a* may connect the primary piston 16 to the secondary pistons 17 and 17*a*, respectively.

A condenser 24 may be disposed in fluid communication with the cylinder outlet valves 12, 12*a* on the primary cylinder 7 of the piston assembly 6 through an exhaust manifold 20. The boiler 2 may be disposed in fluid communication with the condenser 24 through a boiler return conduit 26.

The secondary cylinder 8 may be fitted with an inlet check valve 13 and an outlet check valve 14. In like manner, the secondary cylinder 8*a* may be fitted with an inlet check valve 13*a* and an outlet check valve 14*a*. A pressure tank 32 may be disposed in fluid communication with the outlet check valve 14 through a pressure conduit 30 and with the outlet check valve 14*a* through a pressure conduit 30*a*. A turbine/motor 34 may be disposed in fluid communication with the pressure tank 32 through a turbine/motor inlet conduit 33. The turbine/motor 34 may be used to perform work in any of a variety of applications. A fluid reservoir 36 may be disposed in fluid communication with the turbine/motor 34 through a turbine outlet conduit 35. The inlet check valve 13 of the secondary cylinder 8 may be disposed in fluid communication with the fluid reservoir 36 through a working fluid return conduit 31. The inlet check valve 13*a* of the secondary cylinder 8*a* may be disposed in fluid communication with the fluid reservoir 36 through a working fluid return conduit 31*a*.

In exemplary operation of the thermal energy recovery system 1, a working fluid 44 is contained in the secondary cylinders 8, 8*a* of the piston assembly 6. In some applications, the working fluid 44 may be a liquid. In some applications, the working fluid 44 may be a gas. The boiler 2 heats the water or other liquid 42 which subsequently becomes vapor 40 or alternatively, receives the vapor 40 from a vapor source (not illustrated). The cylinder inlet valve and/or liquid injection system 10 and the cylinder outlet valve 12*a* are opened whereas the cylinder inlet valve 10*a* and the cylinder outlet valve 12 are closed. Accordingly, the vapor 40 and/or evaporative liquid enters the primary cylinder 7 through the cylinder inlet valve and/or liquid injection system 10 such that the vapor 40 applies differential pressure against the primary piston 16, causing movement of the piston 16 in the primary cylinder 7 to the right in FIG. 1. In that the vapor 40 on the exhaust side of the primary piston 16 passes through the exhaust manifold 20 to the condenser 24 and is condensed therein, the pressure differential applied to the primary piston 16 is enhanced, allowing for expansion of the working vapor 40 potentially to less than atmospheric pressure. This feature may allow for maximum expansion of the working vapor 40, resulting in increased operational efficiency. This action causes the primary piston 16 to exert pressure against the secondary piston 17*a* through the piston connecting member 18*a*. Consequently, the piston connecting member 18*a* pushes the secondary piston 17*a* in the secondary cylinder 8*a* to the right in FIG. 1. The secondary piston 17*a* displaces the working fluid 44 from the secondary cylinder 8*a* through the outlet check valve 14*a* and the pressure conduit 30*a*, respectively, into and through the pressure tank 32. The pressurized working fluid 44 exits the pressure tank 32 through the turbine inlet conduit 33 and flows through and rotates the turbine/motor 34. The working fluid 44 leaves the turbine/motor 34 through the turbine outlet conduit 35 and enters the fluid reservoir 36. From the fluid reservoir 36, the working fluid return conduit 31*a* returns the working fluid 44 to the secondary cylinder 8 through the working fluid return conduit 31 and the inlet check valve 13, respectively, due to the drop in pressure in the secondary cylinder 8 caused by refraction of the secondary piston 17.

The differential or ratio of the pressure which is applied by the vapor 40 against the primary piston 16 to the pressure which is applied by the secondary piston 17*a* against the working fluid 44 is directly proportional to the square of the radius of the primary piston 16 and the secondary piston 17*a*. The pressure which the secondary piston 17*a* exerts against the working fluid 44 is equal to the pressure which the vapor 40 exerts against the primary piston 16 times the area of the primary piston 16 divided by the area of the secondary piston 17*a*. For example and without limitation, in embodiments in which the diameter of the primary piston 16 is 10 inches and the diameter of the secondary piston 17*a* is 1 inch, the area of the primary piston 16 ($A=\pi r^2$) is 78.5 $in^2$ less the area of the piston connecting member 18*a*. The area of the secondary piston 17*a* is 0.785 $in^2$. Therefore, a pressure of 10 $lbs/in^2$ applied to the primary piston 16 yields a pressure of 1,000 PSI developed by the secondary piston 17*a* (a ratio of 100:1). Piston sizes (primary versus secondary) can be designed so as to optimize working fluid pressures and maximize thermal efficiency.

As it moves to the right in FIG. 1, the primary piston 16 forces vapor 40 from the primary cylinder 7 through the open cylinder outlet valve 12*a*. The exhaust manifold 20 distributes the vapor 40 into the condenser 24, where the vapor 40 is condensed into the liquid 42. As the vapor 40 condenses, its pressure is reduced, resulting in lower vapor pressure on the exhaust side of the primary piston 16. This, in turn, increases the differential pressure on the primary piston 16. The boiler return conduit 26 returns the liquid 42 to the boiler 2 and the process is repeated. In the subsequent power cycle of the piston assembly 6, the cylinder inlet valve and/or liquid injection system 10*a* and the cylinder outlet valve 12 may open while the cylinder inlet valve 10 and the cylinder outlet valve 12*a* may be closed. Vapor 40 from the boiler 2 forces the primary piston 16 to the left in FIG. 1 such that the secondary piston 17 expels the working fluid 44 from the secondary cylinder 8 and through the pressure conduit 30, the pressure tank 32, the turbine inlet conduit 33, the turbine/motor 34, the turbine outlet conduit 35 and the fluid reservoir 36, respectively. From the fluid reservoir 36, the working fluid return conduit 31 returns the working fluid 44 to the secondary cylinder 8*a* through the working fluid return conduit 31*a* and the inlet check valve 13*a*, respectively, due to the drop in pressure in the secondary cylinder 8*a* caused by retraction of the secondary piston 17*a*. Accordingly, as it reciprocates in the primary cylinder 7, the primary piston 16 alternately actuates the secondary piston 17 and the secondary piston 17*a* to maintain a continuous flow of working fluid 44 through the turbine/motor 34. In some applications, the rotating turbine/motor 34 may be used to perform some type of work (such as augmenting a drive train on a vehicle or generating electrical power, for example and without limitation). In other applications, the turbine/motor 34 may operate to compress gas according to the knowledge of those skilled in the art.

Figure 2:
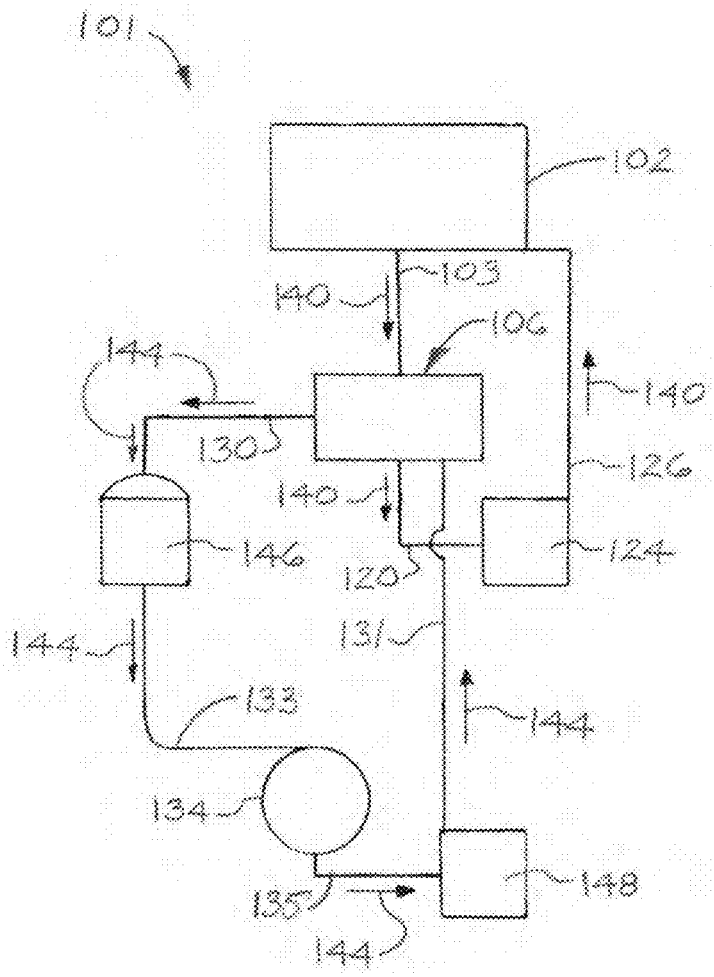
FIG. 2 is a block diagram of an alternative illustrative embodiment of the thermal energy recovery system.

Referring next to FIG. 2 of the drawings, an alternative illustrative embodiment of the thermal energy recovery system is generally indicated by reference numeral 101. In FIG. 2, components which are analogous to the corresponding components of the thermal energy recovery system 1 in FIG. 1 are designated by the same numerals in the 101-199 series. The thermal energy recovery system 101 may include a boiler 102. The boiler 102 may be an exhaust boiler, a solar thermal array, a dedicated boiler or a geothermal source, for example and without limitation. A primary cylinder 7 (FIG. 1) of a piston assembly 106 may be disposed in fluid communication with the boiler 102 through a boiler outlet conduit 103. A condenser 124 may be disposed in fluid communication with the primary cylinder 7 of the piston assembly 106 through an exhaust manifold 120. The boiler 102 may be disposed in fluid communication with the condenser 124 through a boiler return conduit 126.

A working fluid surge reservoir 146 may be disposed in fluid communication with a first secondary cylinder 8 (FIG. 1) of the piston assembly 106 through a pressure conduit 130. A turbine/motor 134 may be disposed in fluid communication with the working fluid surge reservoir 146 through a turbine inlet conduit 133. A working fluid return reservoir 148 may be disposed in fluid communication with the turbine/motor 134 through a turbine outlet conduit 135. A second secondary cylinder 8*a* of the piston assembly 106 may be disposed in fluid communication with the working fluid/return reservoir 148 through a working fluid return conduit 131.

In exemplary operation of the thermal energy recovery system 101, the boiler 102 heats a liquid which subsequently becomes vapor 140 or receives the vapor 140 from a separate vapor source (not illustrated). The vapor 140 flows from the boiler 102 through the boiler outlet conduit 103 into the piston assembly 106, which functions as was heretofore described with respect to the piston assembly 6 of the thermal energy recovery system 1 in FIG. 1. The vapor 140 flows to the condenser 124 through the exhaust manifold 120 and is condensed to form the liquid 140 in the condenser 124. The liquid 140 returns to the boiler 102 through the boiler return conduit 126.

Responsive to operation of the piston assembly 106, pressurized working fluid 144 flows through the pressure conduit 130 into the working fluid surge reservoir 146. From the working fluid surge reservoir 146, the working fluid 144 flows through the turbine inlet conduit 133 and the turbine/motor 134, respectively, rotating the turbine/motor 134. The working fluid 144 flows from the turbine/motor 134 through the turbine outlet conduit 135 and into the working fluid return reservoir 148. Finally, the working fluid return conduit 131 returns the working fluid 144 to the piston assembly 106.

Figure 3:
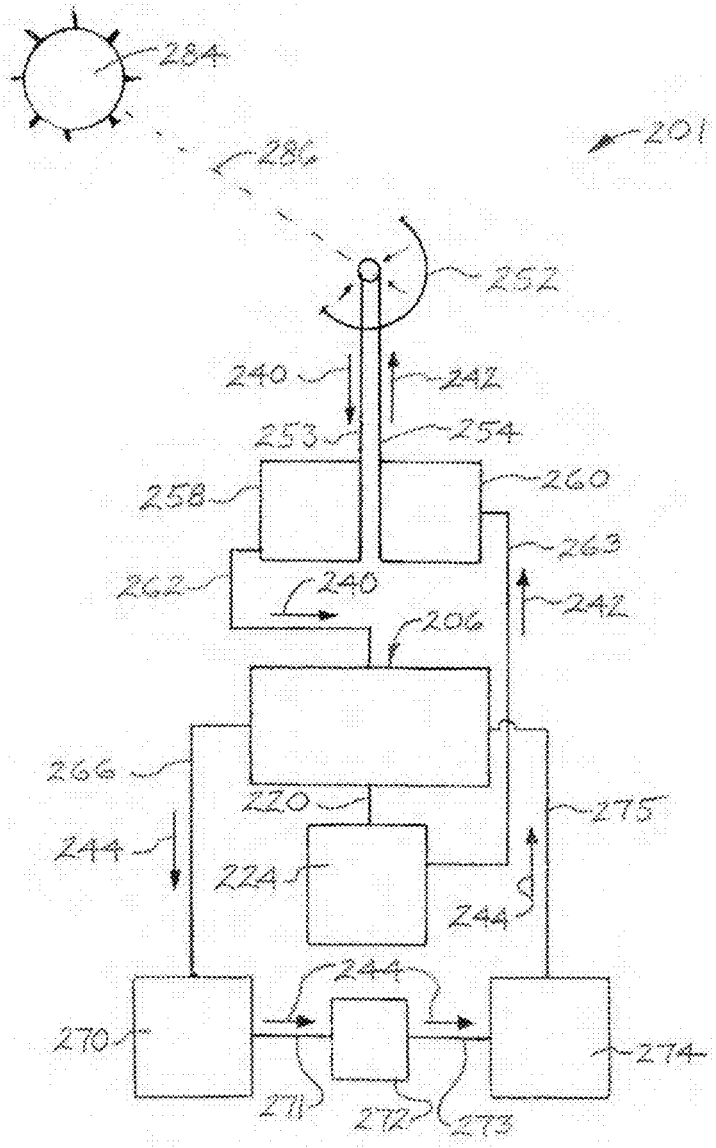
FIG. 3 is a block diagram of an illustrative embodiment of a solar-powered air-conditioning system.

Referring next to FIG. 3 of the drawings, an illustrative embodiment of a solar-powered air conditioning system is generally indicated by reference numeral 201. In FIG. 3, components which are analogous to the corresponding components of the thermal energy recovery system 1 in FIG. 1 are designated by the same numerals in the 201-299 series. The solar-powered air conditioning system 201 may include a thermal energy collector 252. A collector outlet conduit 253 and a collector return conduit 254 may be disposed in fluid communication with each other and in thermally-conductive contact with the thermal energy collector 252. A hot liquid storage tank 258 may be disposed in fluid communication with the collector outlet conduit 253. A cold liquid storage tank 260 may be disposed in fluid communication with the collector return conduit 254. The primary cylinder 7 (FIG. 1) of a piston assembly 206 may be disposed in fluid communication with the hot liquid storage tank 258 through a storage tank outlet conduit 262.

A condenser 224 may be disposed in fluid communication with the primary cylinder 7 of the piston assembly 206 through an exhaust manifold 220. The cold liquid storage tank 260 may be disposed in fluid communication with the condenser 224 through a storage tank return conduit 263.

A radiator 270 may be disposed in fluid communication with a first secondary cylinder 8 (FIG. 3) of the piston assembly 206 through an assembly outlet conduit 266. A refrigerant storage tank 272 may be disposed in fluid communication with the radiator 270 through a radiator outlet conduit 271. An evaporator 274 may be disposed in fluid communication with the refrigerant storage tank 272 through a refrigerant outlet conduit 273. The second secondary cylinder 8*a* (FIG. 1) of the piston assembly 206 may be disposed in fluid communication with the evaporator 274 through an assembly return conduit 275.

In exemplary operation of the solar-powered air conditioning system 201, thermal energy 286 emitted by the Sun 284 heats the thermal energy collector 252. Liquid 242 which flows through the thermal energy collector 252 is heated to produce hot liquid 240, which flows through the collector outlet conduit 253 to the hot liquid storage tank 258. The hot liquid 240 flows from the hot liquid storage tank 258 through the storage tank outlet conduit 262 to the piston assembly 206, where the liquid becomes vapor 240 actuates the piston assembly 206 as was heretofore described with respect to the piston assembly 6 in FIG. 1. From the piston assembly 206, the vapor 240 flows through the exhaust manifold 220 to the condenser 224, where the vapor 240 is condensed into liquid 242. The liquid 242 returns to the cold liquid storage tank 260 through the storage tank return conduit 263. Subsequently, the liquid 242 flows to the thermal energy collector 252 through the collector return conduit 254, and the process is repeated.

Responsive to flow of the vapor 240 into the piston assembly 206, the piston assembly 206 forces refrigerant gas 244 through the assembly outlet conduit 266 to the radiator 270. In the radiator 270, flowing air absorbs heat from the refrigerant gas 244, which then in a cooled state flows through the radiator outlet conduit 271 to the refrigerant storage tank 272. The refrigerant gas 244 flows through the refrigerant outlet conduit 273 to the evaporator 274, where the refrigerant gas 244 absorbs heat from flowing air and cools the air. The air which is cooled by the refrigerant gas 244 in the evaporator 274 may be distributed into an enclosed or partially enclosed space such as rooms (not illustrated) of a home or other building through ductwork or the like to cool the building typically in the same manner as a conventional air conditioning system. The refrigerant gas 244 returns to the piston assembly 206 through the assembly return conduit 275 and the process is repeated.

Figure 4:
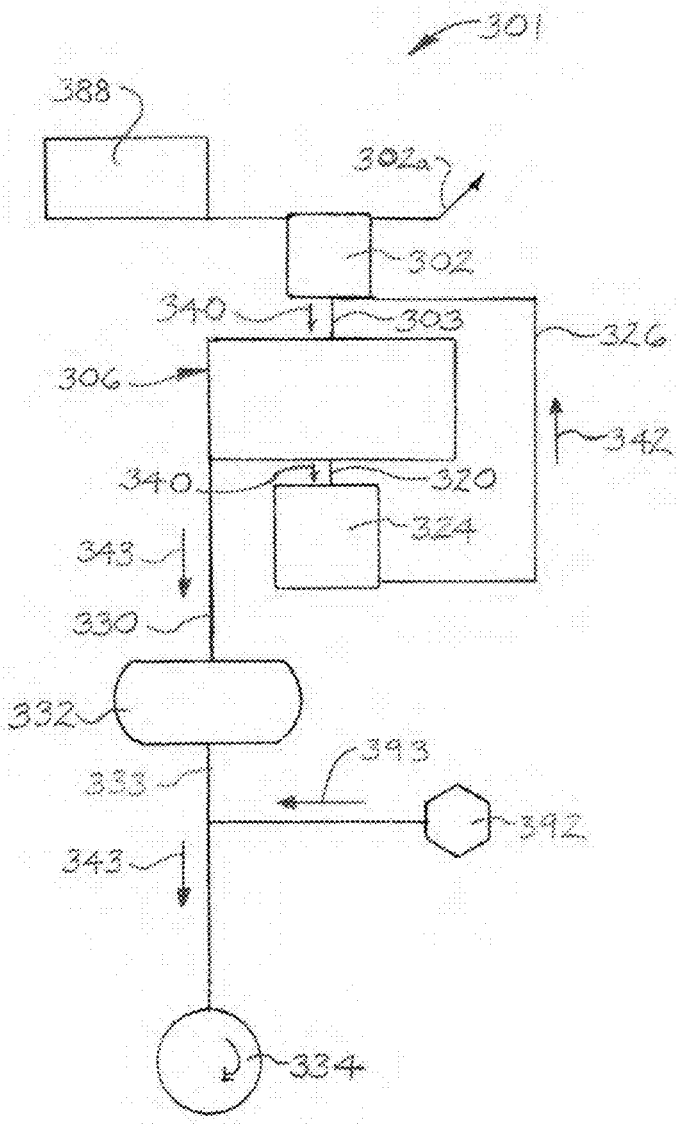
FIG. 4 is a block diagram of an illustrative embodiment of a vehicle propulsion system.

Referring next to FIG. 4 of the drawings, an illustrative embodiment of a propulsion system for road and rail vehicles is generally indicated by reference numeral 301. In FIG. 4, components which are analogous to the corresponding components of the thermal energy recovery system 1 in FIG. 1 are designated by the same numerals in the 301-399 series. The propulsion system 301 may include a motor 388 which in some applications may be the primary mover of a road or rail vehicle. In some embodiments, the motor 388 may include an internal combustion engine. A boiler 302 may be disposed in thermal contact with the motor 388 or with exhaust gas 302*a* from the motor 388.

The primary cylinder 7 (FIG. 1) of a piston assembly 306 may be disposed in fluid communication with the boiler 302 through a boiler outlet conduit 303. A condenser 324 may be disposed in fluid communication with the primary cylinder 7 of the piston assembly 306 through an exhaust manifold 320. The boiler 302 may be disposed in fluid communication with the condenser 324 through a boiler return conduit 326.

A pressurized air or other gaseous medium storage tank 332 may be disposed in fluid communication with a first secondary cylinder 8 (FIG. 1) of the piston assembly 306 through a pressure conduit 330. A turbine/motor 334 may be disposed in fluid communication with the pressurized air or gaseous medium storage tank 332 through a turbine inlet conduit 333. In some applications, the turbine/motor 334 may drivingly engage a vehicle drive train (not illustrated) of the road or rail vehicle to augment the driving power of the motor 388. The turbine/motor 334 may additionally be coupled to the braking system (not illustrated) of the road or rail vehicle for regenerative braking purposes according to the knowledge of those skilled in the art. In some embodiments, an external air compressor 392 may be disposed in fluid communication with the turbine inlet conduit 333 between the pressurized air storage tank 332 and the turbine/motor 334.

In exemplary operation of the propulsion system 301, the motor 388 may be operated as the primary mover of the road or rail vehicle. Exhaust gases 302*a* from the motor 388 heats the boiler 302 such that liquid 342 in the boiler 302 is heated and subsequently becomes vapor 340. The vapor 340 flows through the boiler outlet conduit 303 to the piston assembly 306, which is operated in a manner similar to that heretofore described with respect to the piston assembly 6 in FIG. 1. From the piston assembly 306, the vapor 340 flows through the exhaust manifold 320 to the condenser 324, where the vapor 340 is condensed into liquid 342. The liquid 342 returns to the boiler 302 through the boiler return conduit 326 and the process is repeated.

Responsive to flow of the vapor 340 into the piston assembly 306, the piston assembly 306 compresses and forces air or gaseous medium 343 through the pressure conduit 330 to the pressurized air storage tank 332. The compressed gas 343 flows from the pressurized gas storage tank 332 through the turbine inlet conduit 333 to the turbine/motor 334 and drives the turbine/motor 334. In some applications, the turbine/motor 334 may drive the vehicle drive train (not illustrated) of the road or rail vehicle to augment the driving power of the motor 388. In some applications, the turbine/motor 334 may be reversible to provide regenerative braking capability according to the knowledge of those skilled in the art. In some applications, such as under circumstances in which the motor 388 is not being operated, for example, the external gas compressor 392 may be operated to force compressed gas 393 to the turbine/motor 334 through the turbine inlet conduit 333.

While exemplary embodiments of the disclosure have been described above, it will be recognized and understood that various modifications can be made in the disclosure and the appended claims are intended to cover all such modifications which may fall within the spirit and scope of the disclosure.

What is claimed is:

1. A thermal energy recovery system, comprising:

an internal combustion engine;

a vapor source disposed in thermal contact with the engine or with exhaust gas from the engine or other combustion system, geothermal steam or hot water, or an electric boiler/water heater powered by a photovoltaic array or a solar thermal collector, the vapor source adapted to contain vapor or liquid in such a state so as to become vapor;

a piston assembly including:

a primary displacement volume adapted to receive vapor or liquid in such a state so as to become vapor from the vapor source;

first and second secondary cylinders extending from opposite ends of the primary displacement volume;

a primary piston disposed for displacement in the primary displacement volume;

first and second secondary pistons disposed for displacement in the first and second secondary cylinders, respectively, a pressure ratio applied to the primary piston and each of the first and second secondary pistons being up to about 100:1, thereby amplifying a pressure exerted on the primary piston raising a pressure of a working liquid in the secondary cylinders sufficient to efficiently power a liquid turbine/motor;

at least one piston connecting member connecting the first and second secondary pistons to the primary piston;

a first cylinder inlet valve and a second cylinder inlet valve disposed in fluid communication with the primary displacement volume, the vapor source disposed in fluid communication with the first cylinder inlet valve and the second cylinder inlet valve through a vapor source outlet conduit connecting the vapor source to the first cylinder inlet valve and the second cylinder inlet valve;

a first cylinder outlet valve and a second cylinder outlet valve disposed in fluid communication with the primary displacement volume;

a condenser disposed in fluid communication with the first cylinder outlet valve and the second cylinder outlet valve whereby the condenser acts on residual vapor on a side of the primary piston opposite a pressurized side turning the vapor to liquid, hence reducing a volume of the vapor and reducing a resulting pressure to a level approaching zero;

a first inlet check valve disposed in fluid communication with the first secondary cylinder, a second inlet check valve disposed in fluid communication with the second secondary cylinder and a fluid reservoir disposed in fluid communication with the first inlet check valve and the second inlet check valve;

a first outlet check valve disposed in fluid communication with the first secondary cylinder, a second outlet check valve disposed in fluid communication with the second secondary cylinder and a pressure vessel disposed in fluid communication with the first outlet check valve and the second outlet check valve; and a turbine/motor powered by pressurized fluid and having a turbine/motor inlet disposed in fluid communication with the pressure vessel and a turbine/motor outlet disposed in fluid communication with the fluid reservoir, the turbine/motor powered by pressurized fluid, the first secondary cylinder, the second secondary cylinder, the pressure vessel and the fluid reservoir forming a closed loop, whereby introduction of vapor into the primary displacement volume applies a uniform pressure to the primary piston throughout a stroke length of the primary piston, thus pressurizing a working fluid in the first and second secondary cylinders to a uniform pressure resulting in a steady volume of working fluid at uniform pressures being delivered to the turbine/motor powered by pressurized fluid.

2. A thermal energy recovery system, comprising:

a first motor;

a vapor source disposed in thermal contact with the first motor or with exhaust gas from the first motor or other combustion system, geothermal steam or hot water, or an electric boiler/water heater powered by a photovoltaic array, or a solar thermal collector, the vapor source adapted to contain vapor or liquid in such a state so as to become vapor;

a piston assembly including:

a primary cylinder;

first and second secondary cylinders extending from opposite ends of the primary cylinder, the first and secondary cylinders configured to contain a working fluid;

a primary piston disposed for displacement in the primary cylinder;

first and second secondary pistons disposed for displacement in the first and second secondary cylinders, respectively, a pressure ratio applied to the primary piston and each of the first and second secondary pistons being up to about 100:1, thereby amplifying a pressure exerted on the primary piston and raising a pressure of a working liquid in the secondary cylinders sufficient to efficiently power a liquid turbine/motor;

a piston connecting member connecting the first and second secondary pistons to the primary piston;

a first cylinder inlet fluid injection system and a second cylinder inlet fluid injection system disposed in fluid communication with the primary cylinder and adapted to receive a vapor from the vapor source, the vapor source disposed in fluid communication with the first cylinder inlet fluid injection system and the second cylinder inlet fluid injection system through a vapor source outlet conduit connecting the vapor source to the first cylinder inlet fluid injection system and the second cylinder inlet fluid injection system; and a first cylinder outlet valve and a second cylinder outlet valve disposed in fluid communication with the primary cylinder;

a condenser disposed in fluid communication with the first cylinder outlet valve and the second cylinder outlet valve whereby the condenser acts on residual vapor on a side of the primary piston opposite a pressurized side turning the vapor to liquid, hence reducing a volume of the vapor and reducing a resulting pressure to a level approaching zero;

a first inlet check valve disposed in fluid communication with the first secondary cylinder, a second inlet check valve disposed in fluid communication with the second secondary cylinder and a fluid reservoir disposed in fluid communication with the first inlet check valve and the second inlet check valve;

a first outlet check valve disposed in fluid communication with the first secondary cylinder, a second outlet check valve disposed in fluid communication with the second secondary cylinder and a pressure vessel disposed in fluid communication with the first outlet check valve and the second outlet check valve;

a turbine/motor powered by pressurized fluid and disposed in fluid communication with the pressure vessel/accumulator on the inlet side of the fluid reservoir on the turbine/motor outlet side, the vapor source provides vapor to the primary cylinder to actuate the primary cylinder and the secondary cylinders, and the secondary cylinders provide working fluid to the turbine/motor powered by pressurized fluid to actuate the turbine/motor powered by pressurized fluid, whereby pressure applied to the working fluid used to power the turbine/motor powered by pressurized fluid is proportional to a total effective net pressure applied to the primary piston divided by the area of the secondary piston, thus imparting sufficient pressure to the working fluid to efficiently power the turbine/motor powered by pressurized fluid; and the turbine/motor powered by pressurized fluid, the first secondary cylinder, the second secondary cylinder, the pressure vessel and the working fluid reservoir forming a closed loop, the turbine/motor powered by pressurized fluid having a turbine/motor inlet disposed in fluid communication with the pressure vessel and a turbine/motor outlet disposed in fluid communication with the fluid reservoir, whereby introduction of vapor into the primary displacement volume applies a uniform pressure to the primary piston throughout a stroke length of the primary piston, thus pressurizing a liquid working fluid in the first and second secondary cylinders to a uniform pressure resulting in a steady volume of liquid working fluid at uniform pressures being delivered to the turbine/motor powered by pressurized fluid.

3. The thermal energy recovery system of claim 2 wherein the condenser is disposed in fluid communication with the primary cylinder and the vapor source.

4. A thermal energy recovery system, comprising:

a device adapted to receive vapor or a liquid in a thermal condition to become or produce vapor, which has been generated by at least one of the following: a boiler in thermodynamic connection/contact with a combustion system, a heat engine and/or exhaust from a heat engine, a source of geothermal steam and/or hot water and/or a boiler in thermodynamic connection/contact with a geothermal source of steam and/or hot water, a solar thermal collector and/or a boiler which is in thermodynamic connection/contact with a solar thermal connector, an electric boiler/water heater powered by a solar array, a source of liquid arising from a nuclear reactor that is in a thermodynamic condition to become or produce vapor and/or a boiler in thermodynamic connection/contact with a source of liquid arising from a nuclear reactor, or a source of compressed gas;

a piston assembly including:

a primary displacement volume adapted to receive vapor or liquid in such a state so as to become vapor from the device;

first and second secondary cylinders extending from opposite ends of the primary displacement volume;

a primary piston disposed for displacement in the primary displacement volume;

first and second secondary pistons disposed for displacement in the first and second secondary cylinders, respectively, a pressure ratio applied to the primary piston and each of the first and second secondary pistons being up to about 100:1, thereby amplifying a pressure exerted on the primary piston raising a pressure of a working liquid in the secondary cylinders sufficient to efficiently power a liquid turbine/motor;

at least one piston connecting member connecting the first and second secondary pistons to the primary piston;

a first cylinder inlet valve and a second cylinder inlet valve disposed in fluid communication with the primary displacement volume, the device disposed in fluid communication with the first cylinder inlet valve and the second cylinder inlet valve through a device outlet conduit connecting the device to the first cylinder inlet valve and the second cylinder inlet valve;

a first cylinder outlet valve and a second cylinder outlet valve disposed in fluid communication with the primary displacement volume;

a condenser disposed in fluid communication with the first cylinder outlet valve and the second cylinder outlet valve whereby the condenser acts on residual vapor on a side of the primary piston opposite a pressurized side turning the vapor to liquid, hence reducing a volume of the vapor and reducing a resulting pressure to a level approaching zero;

a first inlet check valve disposed in fluid communication with the first secondary cylinder, a second inlet check valve disposed in fluid communication with the second secondary cylinder and a fluid reservoir disposed in fluid communication with the first inlet check valve and the second inlet check valve;

a first outlet check valve disposed in fluid communication with the first secondary cylinder, a second outlet check valve disposed in fluid communication with the second secondary cylinder and a pressure vessel disposed in fluid communication with the first outlet check valve and the second outlet check valve; and a turbine/motor powered by pressurized fluid and having a turbine/motor inlet disposed in fluid communication with the pressure vessel and a turbine/motor outlet disposed in fluid communication with the fluid reservoir, the turbine/motor powered by pressurized fluid, the first secondary cylinder, the second secondary cylinder, the pressure vessel and the fluid reservoir forming a closed loop, whereby introduction of vapor into the primary displacement volume applies a uniform pressure to the primary piston throughout a stroke length of the primary piston, thus pressurizing a working fluid in the first and second secondary cylinders to a uniform pressure resulting in a steady volume of working fluid at uniform pressures being delivered to the turbine/motor powered by pressurized fluid.

* * * * *